United States Patent [19]

Epple

[11] Patent Number: 4,899,425

[45] Date of Patent: Feb. 13, 1990

[54] APPARATUS FOR STRAIGHTENING WEFT YARNS IN FABRICS

[75] Inventor: Helmut Epple, Saal/Donau, Fed. Rep. of Germany

[73] Assignee: Mahlo GmbH & Co. Kg., Saal/Donau, Fed. Rep. of Germany

[21] Appl. No.: 108,020

[22] Filed: Oct. 13, 1987

[30] Foreign Application Priority Data

Nov. 14, 1986 [DE] Fed. Rep. of Germany ..... 3638909
May 6, 1987 [DE] Fed. Rep. of Germany ..... 3715086

[51] Int. Cl.[4] ..... D06C 3/06
[52] U.S. Cl. ..... 26/51.4
[58] Field of Search ..... 26/51.3, 51.4, 51.5, 26/90

[56] References Cited

U.S. PATENT DOCUMENTS

| | | | |
|---|---|---|---|
| Re. 9,452 | 11/1980 | Palmer | 26/51.3 |
| 416,343 | 12/1889 | Palmer | 26/90 X |
| 883,535 | 3/1908 | Gessner | 26/90 |
| 3,146,511 | 9/1964 | Hoffman | 26/51.4 |
| 3,636,598 | 1/1972 | Hannaway | 26/51.4 |
| 3,751,774 | 8/1973 | Hannaway | 26/51.4 |
| 4,497,740 | 1/1985 | Noburu et al. | 26/90 X |

FOREIGN PATENT DOCUMENTS

| | | | |
|---|---|---|---|
| 0136115 | 4/1985 | European Pat. Off. . | |
| 155242 | 10/1904 | Fed. Rep. of Germany | 26/90 |
| 2318243 | 10/1973 | Fed. Rep. of Germany . | |
| 2245306 | 5/1974 | Fed. Rep. of Germany . | |
| 1264238 | 5/1961 | France . | |
| 2180390 | 11/1973 | France . | |
| 2956 | of 1876 | United Kingdom | 26/90 |
| 114688 | 4/1918 | United Kingdom | 26/51.3 |
| 144906 | 6/1920 | United Kingdom | 26/51.4 |

OTHER PUBLICATIONS

Schussfaden-Richtgerat zum Richten schussverzogener Webwaren—D. Riedel—Textile Practice International, Oct. 1986, pp. 1115, 1116.

*Primary Examiner*—Werner H. Schroeder
*Attorney, Agent, or Firm*—Burgess, Ryan & Wayne

[57] ABSTRACT

A process and apparatus for straightening weft yarns in fabrics in which a continuous fabric web is stretched over a defined longitudinal section with a force increasing in the direction of movement, essentially in the weft direction, between two marginal tensioning drums movable independently of each other in a manner such that the different forces that appear when a diagonal distortion occurs, can be compensated in the direction of movement on the tensioning means so as to remove the distortion, the tensioning means being driven to prevent the frictional forces that necessarily appear from being overcome by take-off forces in the fabric web so that no curved distortions occur.

3 Claims, 11 Drawing Sheets

APPARATUS FOR STRAIGHTENING WEFT YARNS IN FABRICS

BACKGROUND OF THE INVENTION

The present invention is directed to a process and apparatus for straightening weft yarns in fabrics.

Such process is known generally from Textile Practice International, Oct. 1986, pages 1115–1116. During the production of a normal fabric in a weaving machine, the wrap and weft yarns intersect precisely at right angles. However during the different working cycles in the equipment, the fabric can often become distorted. This distortion must be compensated or eliminated for different reasons.

Straightening devices of different kinds are available for correcting weft yarn distortions. The essential question here concerns roller assemblies disposed diagonal to each other. In addition, there are known differentially operating straightening machines wherein both chain drives of a tentering frame are controlled differently so as to align the weft yarns perpendicular to the direction of advance. But in all these straightening machines, it is necessary, in the first place, to determine the course of the weft yarns to be able then to carry out an adequate motor-driven adjustment of the straightening elements.

An essential advantage of the alignment when tension is simultaneously applied in the direction of the weft yarn is that the S-shaped and wavy distortions, etc. are automatically compensated to a great extent due to the stretch of the fabric.

It has been known for many years that an "automatic" compensation of the distortion can be obtained by needling the edges of the fabric web on wheels which have their axes of rotation disposed diagonally to the direction of movement in a manner such that the fabric web is substantially needled without width elongation and is then stretched during the (partial) rotation. The wheels here are free-wheelingly fastened upon their shafts. As long as the weft yarns are perpendicular to the direction of movement, that is, without distortion, the forces acting upon both wheels are equal during the tension. But as soon as a diagonal distortion is present in the fabric, a force acts between the wheels in the longitudinal direction of the fabric that brakes the wheel to the side with the "current" weft yarns and accelerates the wheel to the other side (lagging weft yarn). Among others, an essential problem here consists in that the needling on the wheels is really different and often results in the fabric being torn or moving down from the wheel. In published European Patent Application No. 136 115, there is described an assembly in which this disadvantage can be prevented. But even in this assembly, the needling is relatively difficult. Moreover, an additional problem appears in this assembly (as also in the former assemblies). Such problem directly results from the fact that the clamping wheels move freely and the fabric is removed by a take-up roller so that a curved distortion occurs since the fabric has been "braked" on its edges.

OBJECTS AND SUMMARY OF THE INVENTION

Departing from the above cited prior art, the problem to be solved by this invention is to develop a process and apparatus of the kind mentioned in the sense of improving the straightening of the distortion.

This problem is solved by the process and the apparatus as disclosed herein.

The above and other objects, features and advantages of the invention will be apparent from the following detailed description which is to be read in connection with the accompanying drawings.

DETAILED DESCRIPTION OF THE PREFERRED EMBODIMENTS

Figure 1:
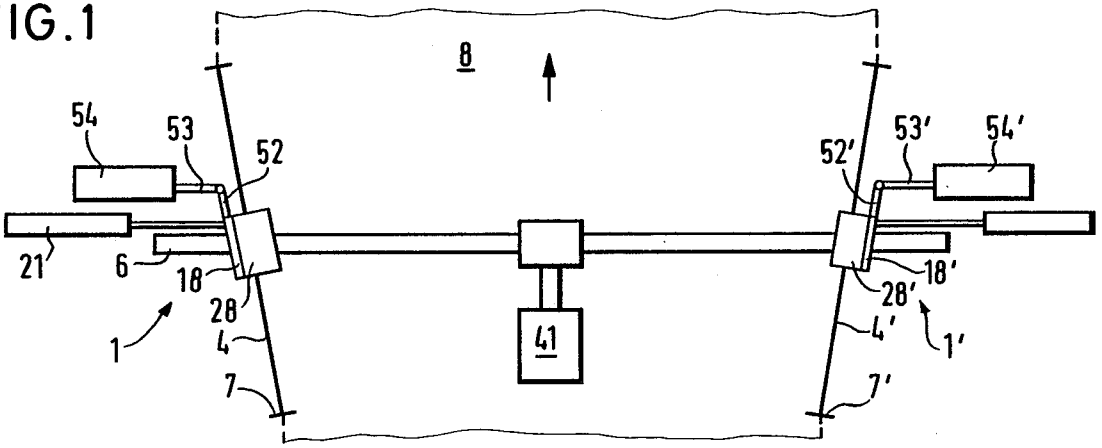
FIG. 1 is a schematic top plan view of a first preferred embodiment of the invention.

As shown in FIG. 1, a fabric web 8 is guided via two tensioning drums or means 1, 1' in a manner such that the width of fabric 8 is less at the inlet than at the outlet. In addition, as will be described herebelow in more detail, the fabric web is retained on peripheral areas 7, 7' of tensioning drums and guided along over a defined peripheral angle. The peripheral areas 7, 7' are fastened via spoke elements 4,4' on turn sleeves 28, 28' which are non-rotationally connected with a shaft 6 via hinges described in more detail below. Shaft 6 is driven by a driving motor 41.

Figure 3:
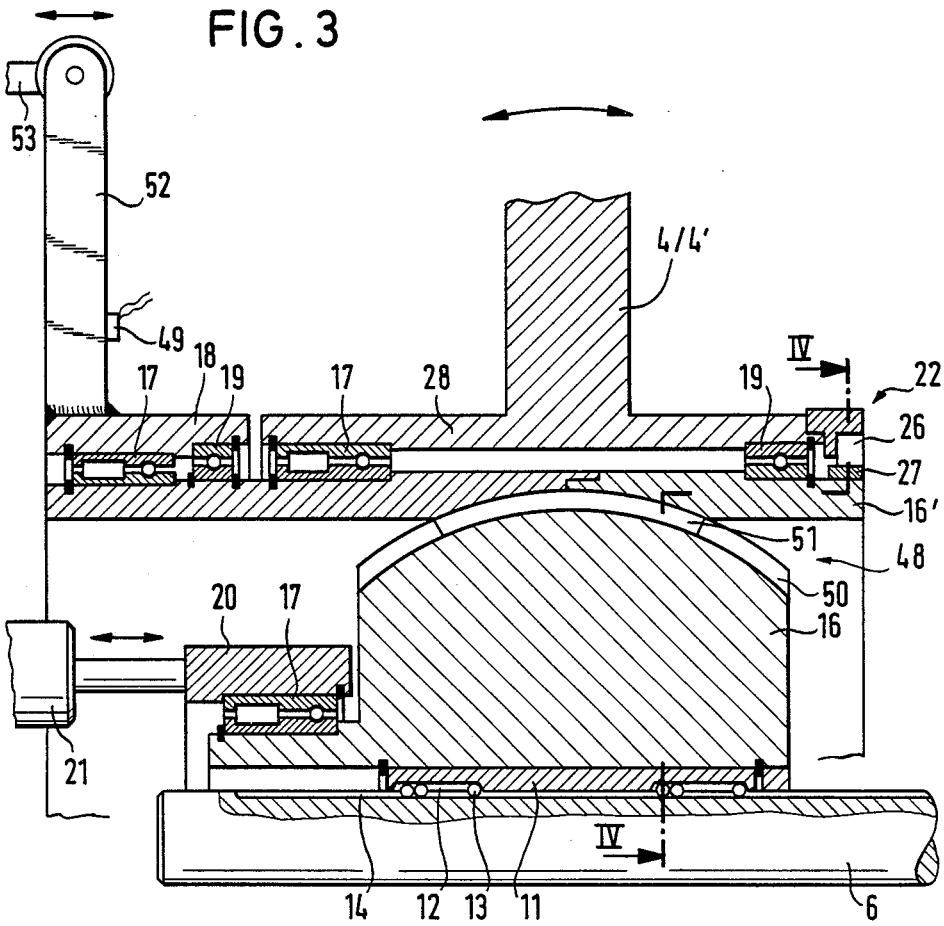
FIG. 3 is a longitudinal cross-sectional view through a drag hinge of the apparatus of FIG. 1.
Figure 4:
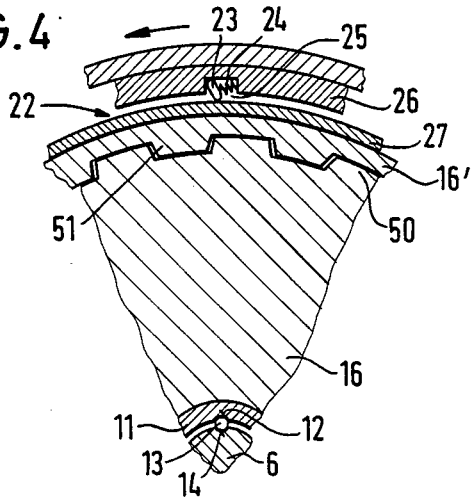
FIG. 4 is a cross-sectional view of FIG. 3, taken along line IV—IV thereof.

Herebelow is described, in more detail with reference to FIGS. 3 and 4, the flexible connection between drums 1, 1' and the drive shaft 6.

According to FIGS. 3 and 4, a sliding sleeve 11 rests on shaft 6 and is rotationally secured via balls 13 that move in grooves 12 and 14 in sliding sleeve 11 and shaft 6 respectively. In the axial direction of shaft 6, sleeve 11 is thus movable with only slight friction On the sliding sleeve 11 rests a carrier sleeve 16 which carries on its periphery an outer toothing 50 that has a spherical outer surface. The ball center rests on the point of intersection of the axis of rotation of shaft 6, and symmetrically with respect to the front surface of the toothing 50.

An inner toothing 51 placed in a second carrier sleeve 16' meshes with outer toothing 50, the carrier sleeve 16' preferably being made of two pieces to make it easier to produce toothing 51. The sleeve 16' is thus non-rotationally connected with sleeve 16 but it can be tilted about the ball center of the toothing perpendicular to shaft 6.

Upon sleeve 16' is supported a turn sleeve 28 via ball bearings 19 and axial-radial bearings 17. Between turn sleeve 28 and carrier sleeve 16' is a free-wheel 22 consisting of an outer portion 26 firmly connected with turn sleeve 28 and having a groove that contains a lock spring 24 which presses a shim 23 upon the outer peripheral areas of an inner portion 27 which is firmly connected with carrier sleeve 16'. This kind of assembly ensures that rotation of turn sleeve 28 is possible in the direction of the arrow (FIG. 4) in respect to inner portion 27 and thus to shaft 6. The direction of drive of shaft 6 is here likewise in the direction of the arrow; and fabric web 8 is likewise guided in the direction of the arrow beyond the outer peripheral areas 7, 7', which are retained by spoke elements 4,4' upon turn sleeve 28. In this manner, the drum peripheral area and therewith the edge of the fabric web concerned can advance in respect to the drive movement and not lag behind.

A guide portion 18 rests on sleeve 16' on the side of the shaft end, and is supported likewise via ball bearings 19 or axial/radial bearings 17. For this purpose, carrier sleeve 16' is correspondingly elongated. A guide lever 52 is attached to guide portion 18 and can be loaded with a pivotal force via a guide slider 53.

Figure 2:
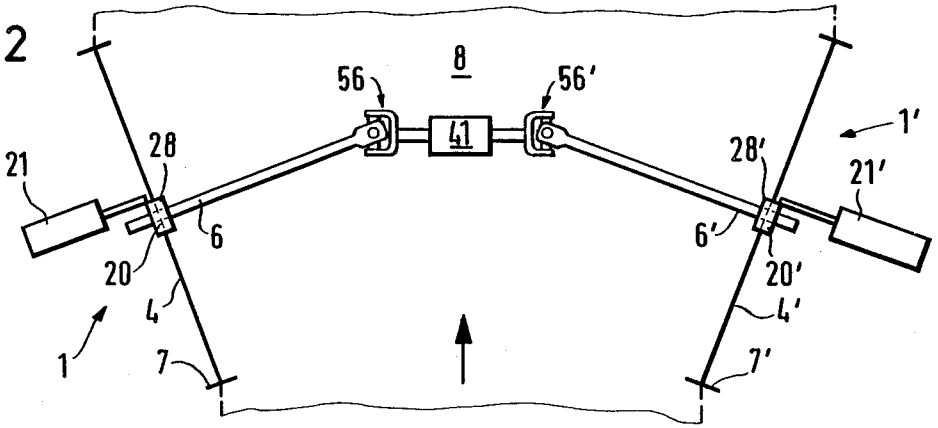
FIG. 2 is a schematic top plan view of another preferred embodiment of the invention.

Guide slider 53 is moved by a cylinder 54, 54' that is stationary or movable only parallel with shaft 6 (see FIG. 1) so that this movement is then transmitted to pivotal movement of the spoke elements. In this pivoted state, which is also shown in FIG. 2, the drum can rotate while being simultaneously carried along by driven shaft 6. The attachment of free-wheel 22 between outer carrier sleeve portion 16' and turn sleeve 28 has, at the same time, the advantage that the free-wheel is more easily started than when free-wheel 22 is mounted between inner carrier sleeve portion 16 and sliding sleeve 11.

As further shown in FIG. 3, a force recorder 49 is provided on the lever 52 (or any other adequate place), which, in the embodiment shown in FIG. 3, can be, for example, a pair of elastic measuring tapes. The tension force applied to the fabric in the weft direction can be determined by force recorder 49. Via the output signal of force recorder 49, it is thus possible to load a control apparatus (not shown here but known per se) which actuates slider 53 according to the force that appears so that to protect the fabric, there can be maintained a maximum force as a threshold.

Figure 5:
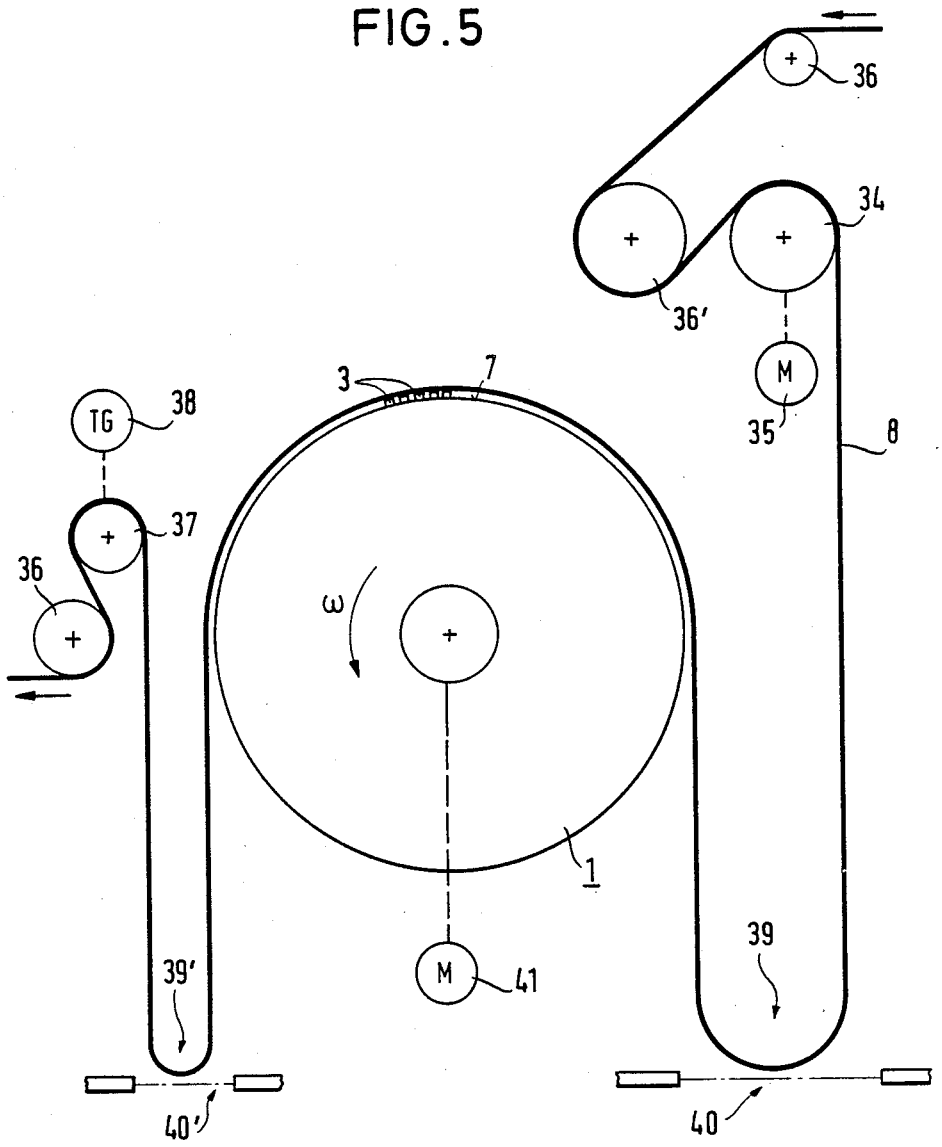
FIG. 5 is a schematic side elevational view of the whole assembly with a drum according to FIG. 1 or 2.

Other features essential to the invention result from FIG. 5. In this figure is diagrammatically shown a side view of the assembly according to FIG. 1 or 2. On the outer peripheral area 7 of each drum is situated a multiplicity of gripping elements 3. The drum 1 (and also the opposite drum 1') is driven via a driving motor 41.

Fabric web 8 is fed to the straightening drums 1, 1' via a guide roller 36 and a centering roller 36' by a carrier roller 34. Carrier roller 34 is driven with adjustable speed by a motor 35. To ensure a specially exact alignment of the distorted fabric and in addition to prevent the curved distortions, it is necessary to avoid as far as possible longitudinal tractive forces when feeding and removing the web from drums 1, 1'. According to FIG. 5, this is further assisted by ascertaining the speed of removal of the fabric web by measuring the speed of a roller 37 with a tach/generator 38 and using it for synchronous control of driving motor 41 of drum 1 and of driving motor 35 of roller 34. For precise correction of the roller speed and for complete relief of tension, the fabric hangs before and behind drum 1, 1', forming in each a loop whose length is detected by light barriers 40 and 40'. Light barrier 40 rectifies the speed of the motor 35 in a manner such that the length of loop 39 remains constant. Light barrier 40' rectifies the speed of driving motor 41 of drums 1, 1' to the constant length of loop 39'.

Figure 6:
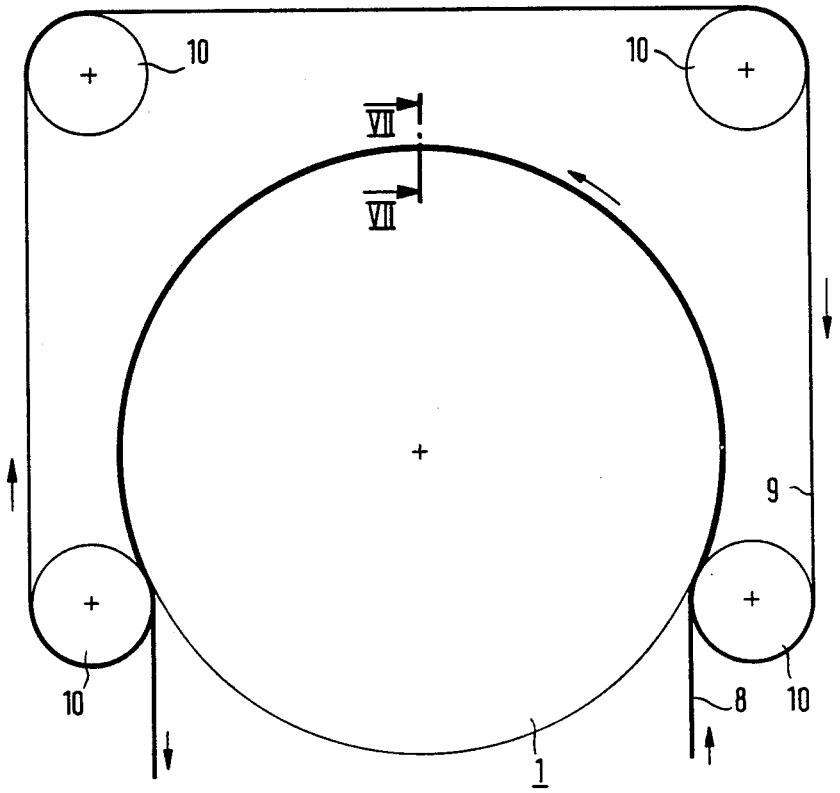
FIG. 6 is a schematic representation of the drum with tension straps.
Figure 7:
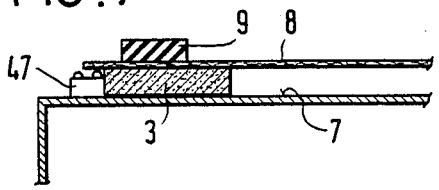
FIG. 7 is a cross-sectional view of FIG. 6, taken along line VII—VII thereof.

When gripping elements 3 are designed as friction cushions, as shown in FIG. 7, a tension strap assembly such as shown in FIGS. 6 and 7 is adequate for pressing it on the drums. In this assembly, a tension strap 9 which is guided by tension rollers 10, synchronously rotates with drum 1 so that a fabric web 8 comes to lie between tension strap 9 and pressure element 3. This assembly ensures that in case of a side elongation that has inadvertently been too firmly adjusted, fabric web 8 can overcome the frictional force and become slightly loosened There are preferably situated on the outer peripheral area 7, a multiplicity of sensors 47 which detect the position of the fabric edge relative to gripping elements 3. The output signals of sensors 47 serve to adjust or limit the side elongation which in turn is accomplished via guide slider 53 or the coordinated guide cylinder 54.

Another essential feature of the assembly shown in FIG. 3 consists in the axial mobility of drums 1, 1' which is effected via a tension flange 20 connected via an axial/radial bearing with the carrier sleeve 16 and which can be adjusted via a tension cylinder 21. Therefore, this adjustment is always in the direction of shaft 6.

Figure 8:
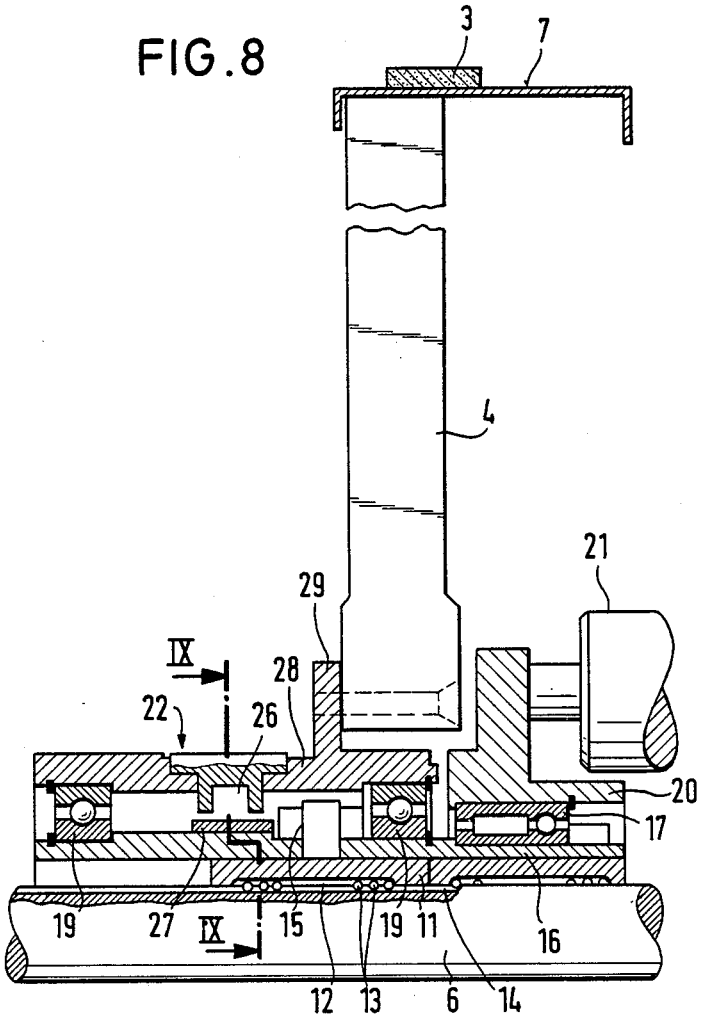
FIG. 8 is a longitudinal cross-sectional view through a drum hub according to FIG. 2.
Figure 9:
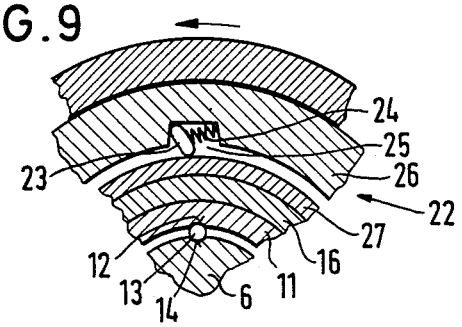
FIG. 9 is a cross-sectional view of FIG. 8, taken along line IX—IX thereof.

Herebelow is described in more detail, the hub of the drum used in the embodiment according to FIG. 2, and in this regard, reference is made to FIGS. 8 and 9.

In this preferred embodiment of the invention, a carrier sleeve 16 rests, likewise non-rotationally, on shaft 6 via a sliding sleeve 11 and balls 13 which can roll in ball grooves 12 and 14 of sliding sleeve 11 or of shaft 6, so as to be movable in the axial direction of the shaft. A turn sleeve 28 moves above sliding sleeve 11 via ball bearings 19, there being likewise provided between turn sleeve 28 and sliding sleeve 11, a free-wheel 22 Such a free-wheel is again shown more precisely in FIG. 9, the numbers shown in FIGS. 8 and 9 corresponding to parts already described in detail in FIG. 3.

In order to effect a displacement of turn sleeve 28 in the axial direction of shaft 6, there rests on carrier sleeve 16, via an axial/radial bearing 17, a spring flange 20 which can be moved by a stationary tensioning cylinder.

Flanged portions 29 are provided on turn sleeve 28 and spoke elements 4 which carry at their ends the drum peripheral area 7 with gripping elements 3 attached thereto are fastened by screws thereto.

Therefore, in the two preferred embodiments of the invention that have hitherto been described, both drums 1, 1' are driven with a minimum velocity determined by the speed of driving motor 41. As soon as a propelling moment, due to a diagonal distortion in the fabric, acts upon drum 1 or 1', the drum can advance by sliding shims 23 upon the outer peripheral area of inner portion 27 so that the diagonal distortion can be adjusted.

In another preferred embodiment of the invention that is not shown in detail here, there-is provided, instead of a free-wheel in each drum hub, a differential gearing (differential) between the driving motor and both drums so that the torques applied to the drum are equal. Therefore, the lagging drum in this case is not accelerated by the force present in the diagonal distortion of the weft yarn so that the distortion adjusts itself, but the forces are kept equal by the differential, which in the effect thereupon passes out.

Figure 10:
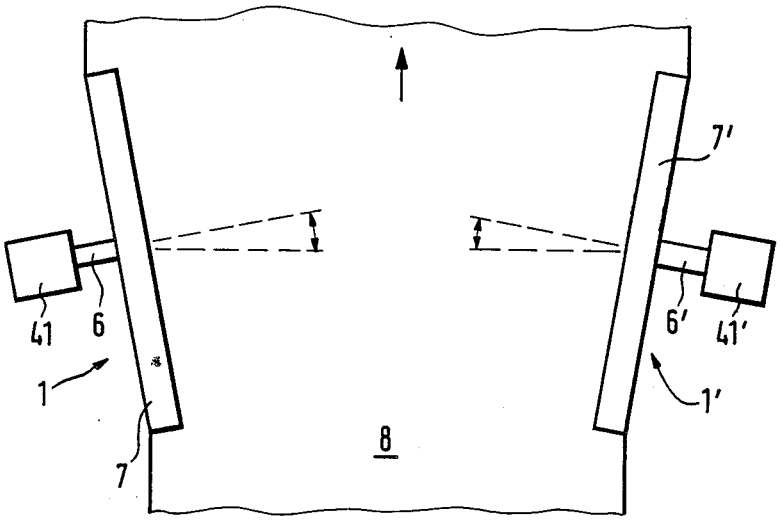
FIG. 10 is a side view of another preferred embodiment of the invention.

Herebelow is described in more detail with reference to FIGS. 10 and 11 another preferred embodiment of the invention wherein again an equality of force is concerned. In this preferred embodiment of the invention, a driving motor 41, 41' is coordinated with each drum 1, 1', such motors being controlled via the output signals of speed transmitter 38 and of light barrier 40' (see FIG. 5). In this embodiment of the invention, there are provided between drums 1, 1' and motors 41, 41', torque transmitters 42, 42' which measure the torque applied by motors 41, 41' to drums 1, 1' and convert it into an electric output signal. Both measured values are compared. The comparison value serves to correct the speed of one of the two driving motors (motor 41' n FIG. 10) and this is accomplished via a regulator R and a servo amplifier. The control system 46 thus formed results in motor 41' always applying the same torque to drum 1' as motor 41 does to drum 1. As described in connection with FIG. 5, the speed of motor 41 is determined via speed transmitter 38 of roller 37, the precise control of the speed being effected via analog light barrier 40'. The control is such that when loop 39' becomes longer, motor 41 is driven more slowly (and vice versa).

By this arrangement, it is ensured that a more exact compensation of the distortion can be effected by means of control system 46 since regulator R of control system 46 can be designed as a PID regulator which can prevent the residual errors that occur in mere proportional regulators of the differential gearing and free-wheel types.

Herebelow is described with reference to FIGS. 12 to 17 another preferred embodiment of the invention wherein the main solution is again the operability of the drums to avoid curved distortion.

Unlike the previously described embodiments of the invention, in this preferred embodiment, the drums themselves are not rigid so that they must be placed diagonally to the feed direction of fabric web 8. In this preferred embodiment, drums 1, 1' are, on the contrary, divided into segments 2, 2' likewise held via spoke elements 4, 4' on the hub of the drum, spoke elements 4 being in this case articulated via hinges 5 on the hub or drum segment 2. This is best seen diagrammatically in FIG. 15.

Figure 15:
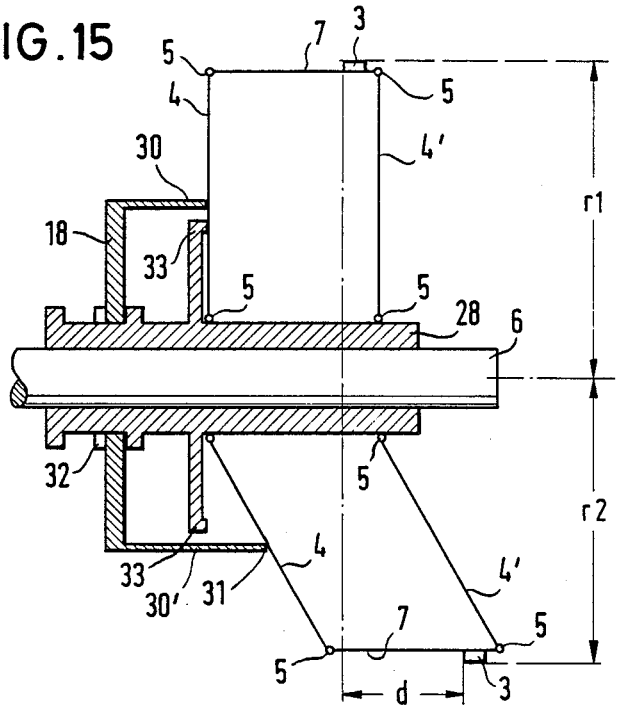
FIG. 15 is a schematic side elevational view, partly in section, of a segmented tensioning drum.

According to this figure, in this preferred embodiment of the invention, the drum comprises separate segments 2 having peripheral areas 7 with an adequate curvature. The hinges 5 by which separate segments 2 are held over spoke elements 4, 4', are designed in a manner such that peripheral areas 7 can be displaced parallel with turn sleeve 28 (see FIGS. 13 and 15) or with shaft 6 upon which turn sleeve 28 is rotatably fastened, but stationary in the axial direction. Due to the fact that spoke elements 4, 4' are equally long, the parallelism between shaft 6 and peripheral surface 7 is always ensured. In FIG. 15 is shown only a "right" drum opposite to a "left" drum 1' constructed with mirror symmetry with the drum shown in FIG. 15. The direction of movement of the fabric is from top to bottom.

The gripping elements 3 on the outer side of the fabric are provided on the drum peripheral area 7 or the separate peripheral areas of segments 2. They can also be screw plates controlled by a force with or without needles, needle rows (optionally impressed in the fabric and removed) or simple frictional elements, as it has been already described above.

Figure 16:
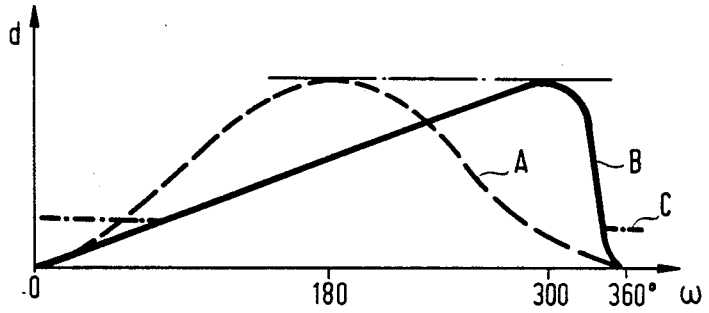
FIG. 16 is a graphical diagram of a course of the elongation over the angle of rotation of a segmented or not segmented drum.

The spacing between left and right gripping elements 3 is determined by cranks-.30 whose edges 31, shown in FIG. 15, serve as axial guide elements When the edge 31 of the crank 30 is wholly in one plane, the crank 30 has the shape of a diagonally cut cylinder As in the previously described embodiments, there results in this case a sinusoidal movement of the gripping elements 3, as shown by the dotted line in FIG. 16. According to the movement of gripping elements 3, there results likewise a sinusoidal side elongation d over the angle of rotation W of the drum. This movement of elongation corresponds to the elongation described above which is effected with the rigid drums.

However, in the embodiment of the invention shown in FIG. 15, there is no limitation to this purely sinusoidal movement of elongation. Since segments 2 can be moved independently of each other, it is possible substantially to effect any desired course of elongation by adequate shaping of crank 30. In FIG. 16 is shown, by way of example, a linear movement (traced curve) in which the fabric is increasing extended with uniformity over an angular value of more than 180°. By this step, it is possible to carry out the elongation movement more slowly and uniformly so as to protect the fabric. In addition, it is possible to effect the elongation passing over a larger angular range, which produces a stronger adjustable force (in the direction of movement) resulting from the sum of the forces applied to the separate weft yarns. Therefore, the bearing friction of the sleeve 28 on the shaft 6 carries less weight in the compensation operation, which is important in the embodiments having free-wheel.

Figure 17:
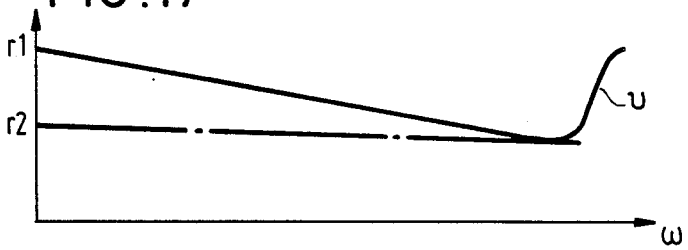
FIG. 17 is a graphical diagram of the course of the diameter of the tensioning drum according to FIG. 15 over the angle of rotation.

Another advantage of the assembly shown in FIGS. 12 to 15 is that the edges of the stretched fabric are moved not only to the right, that is, outwardly in FIG. 15, but simultaneously also, in a direction toward shaft 6, whereby the radius r1 changes to the radius r2, which in turn means a change of the periphery of the drum. After the radius (and therewith the periphery of the drum) decreases, as shown in FIG. 17, there also results a compensation of the longitudinal tension of the fabric due to the lateral extension.

Another feature that makes this invention especially versatile in its use results from FIG. 15. Crank 30 is actually movably supported on turn sleeve 28 in a manner such that maximum movement of gripping elements 3 toward the right (for the right drum) is adjustable by means of the diagrammatically shown crank adjusting means 32. Movement to the left of gripping elements 3 is limited by the detents 33. If the adjusting means 32 in FIG. 15 are moved to the left, there results the motion curve C shown in the dotted line in FIG. 16. Such a motion curve ensures that the fabric web is specially reliably fed to and removed from the drum, since a more certain angular range is available to bring the fabric in frictional or positive (needling) engagement with the drum without the occurrence of a relative movement of an unfixed edge of the fabric in respect to the tensioning means.

Other motion curves can obviously be advantageously used for other reasons. It is, for example, possible to adapt the motion curve to the force/elongation course of the fabric in the lateral direction so as to obtain a constant increase of force during the extension.

Figure 13:
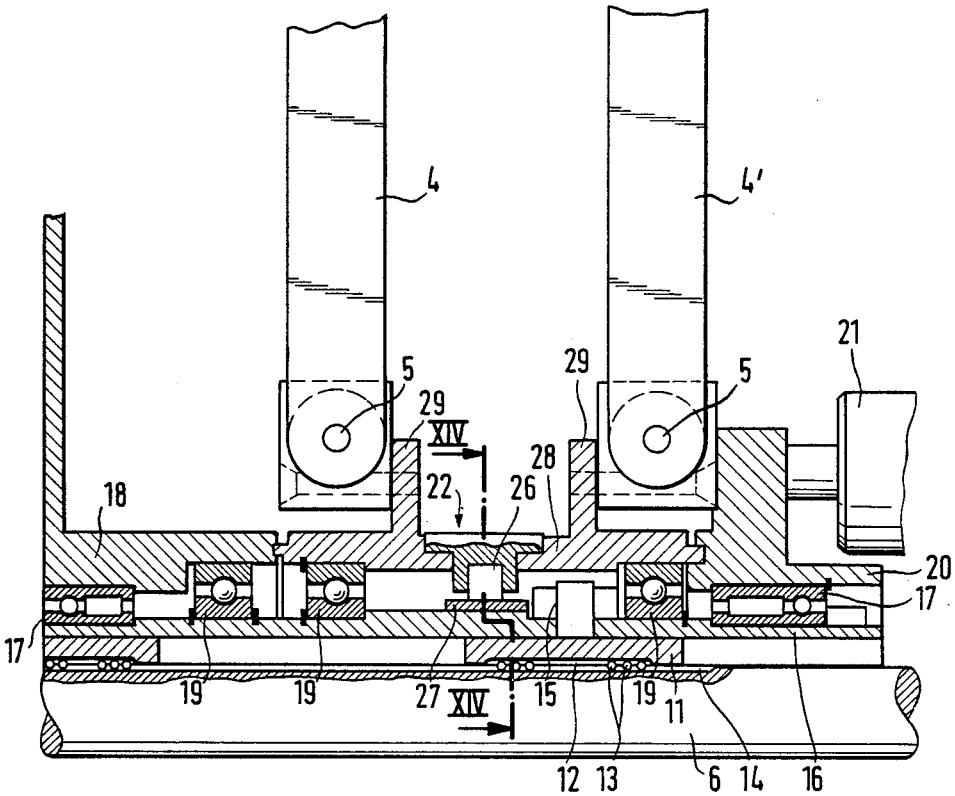
FIG. 13 is a cross-sectional view through the hub of the drums according to FIG. 12 in a representation similar to FIGS. 3 and 8.
Figure 14:
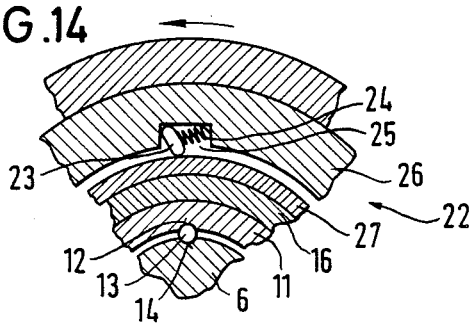
FIG. 14 is a cross-sectional view of FIG. 13, taken along line XIV—XIV thereof.

The construction of this segmented drum is shown in more detail in FIG. 13 wherein this embodiment of the invention, differs from the one according to FIG. 8, on the one hand, by the double number of spoke elements and, on the other, by the fact that crank 30 is supported on guide portion 18. For the rest, the same parts are described with the same reference numerals as in FIG. 8 and are not further explained herein.

As to the detector elements described in connection with FIG. 7, in the segmented design of the drum, the lateral elongation is adjustable by a displacement of crank 30.

Figure 12:
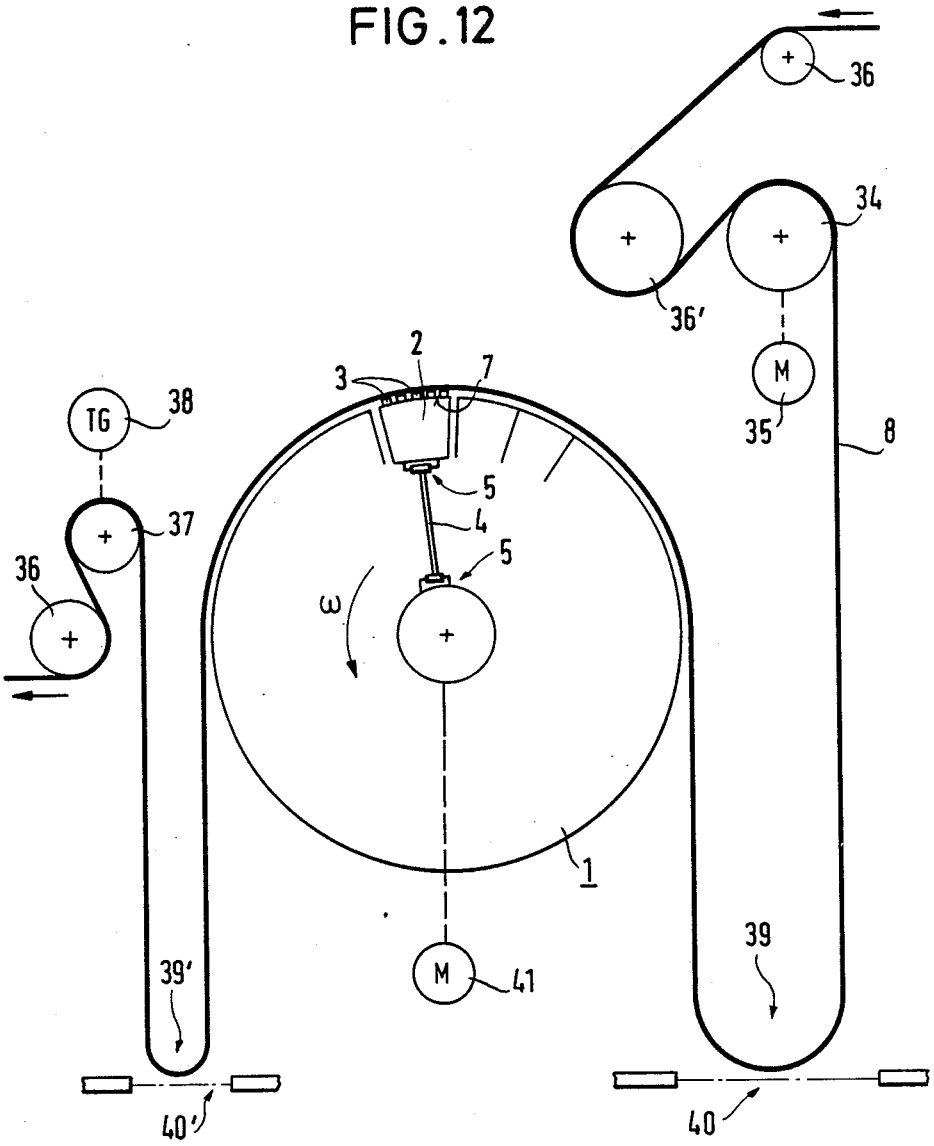
FIG. 12 is a schematic side elevational view of another preferred embodiment of the invention with segmented drums in a representation similar to the one of FIG. 5.

As it results from the preceding description, the individual elements of the invention can be combined, especially in what concerns the free-wheel and the separate operability and design of the drums as "rigid" or segmented separate structural parts. It is of course always important that the drums can be driven whereby longitudinal distortions can be avoided and there can be used a loop guidance of the fabric web, as shown in FIGS. 5 and 12.

Figure 18:
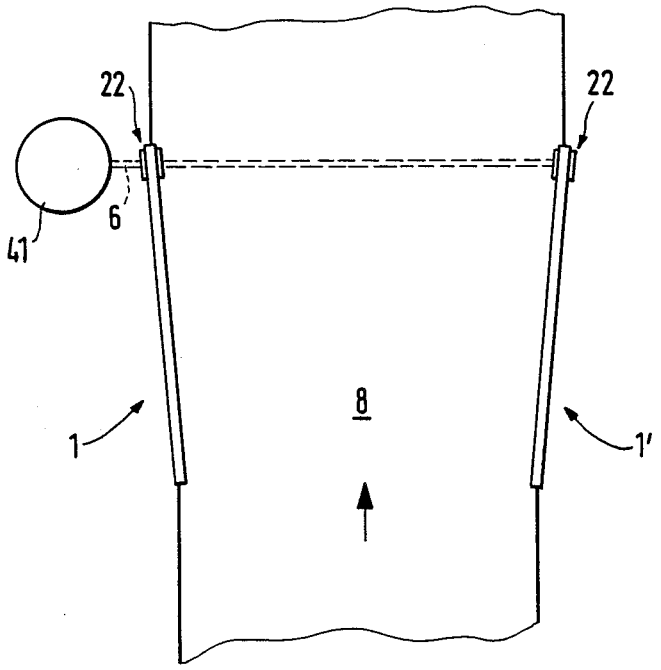
FIG. 18 is a plan view of another preferred embodiment of the invention.

Another preferred embodiment of the invention is shown in FIG. 18, wherein tensioning means 1, 1' form a (short) tentering frame which, in the embodiment shown, comprises in a manner known per se, vertical tractor chains in which are provided screw plates (not shown) which marginally grip, by the edges, fabric web 8 at the inlet and again release it at the outlet. Both tractor chains are driven by a common motor 41 and shaft 6 thereof, there being provided in the driving wheels for the tractor chains, free-wheel assemblies 22 already described above in connection with the drum versions. In this manner, each tractor chain can advance the other but does not remain behind the speed determined by motor 41.

Figure 11:
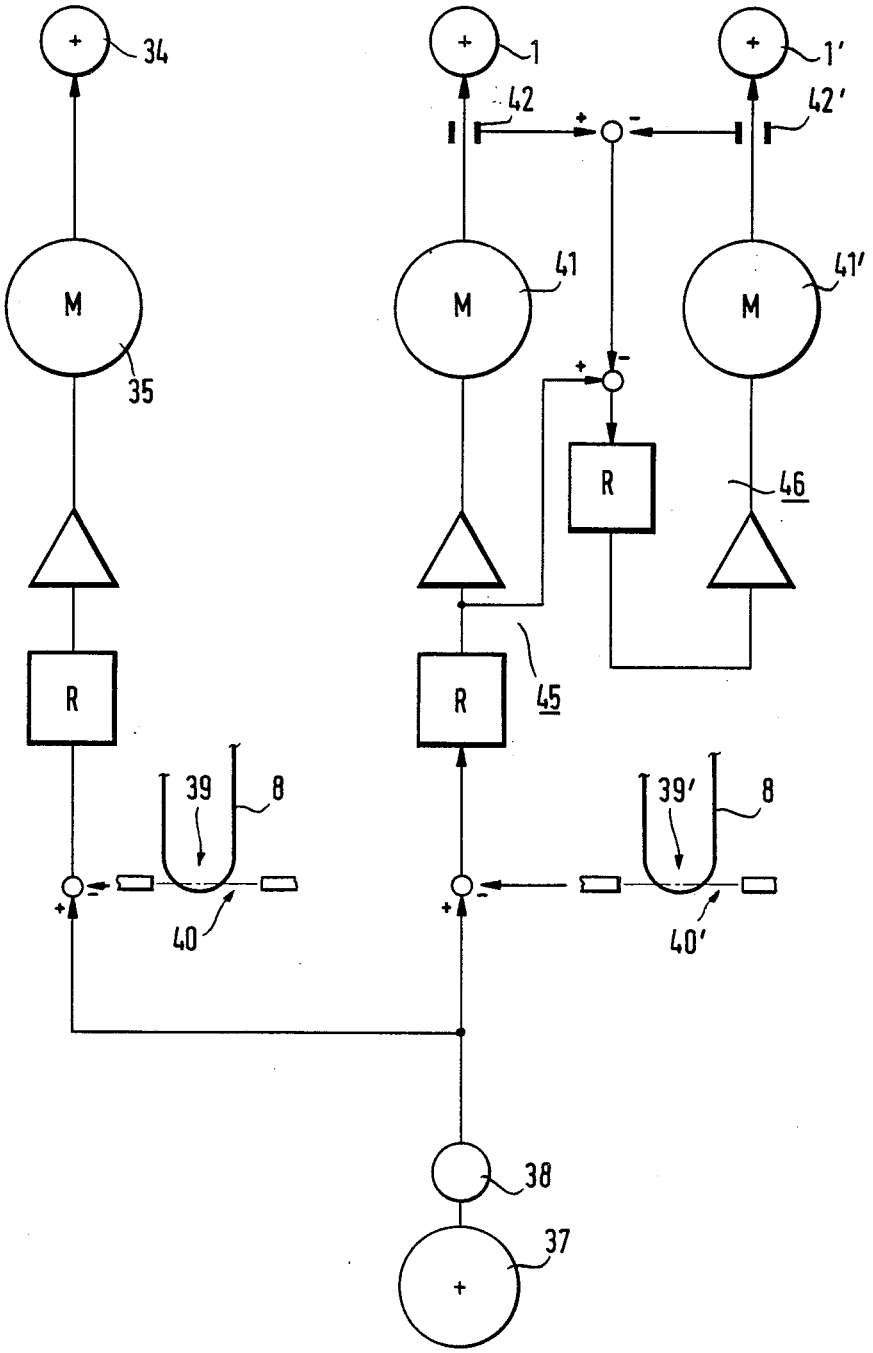
FIG. 11 is a block diagram for control of the assembly according to FIG. 10.

In another embodiment of the invention that is not shown in a figure, both tractor chains are driven not via a single motor with free-wheel but via a drive according to FIG. 11.

From the above representation it can be seen that what is important is that the tensioning means can be driven in a manner such that at least one force advancing in the direction of movement (due to a diagonal distortion) can be compensated by free-wheel, differential, or readjustment of a motor torque.

Having described specific preferred embodiments of the invention with reference to the accompanying drawings, it will be appreciated that the present invention is not limited to those precise embodiments, and that various changes and modifications can be made by one of ordinary skill in the art without departing from the scope or spirit of the invention as defined in the appended claims.

I claim:

1. An apparatus for straightening weft yarns in a continuous fabric web being transported in a transporting direction, comprising:

two tensioning means, situated at margins of said fabric web for retaining respective salvages of said fabric web over a predetermined length thereof and for stretching said fabric web essentially in the weft direction with a force increasing in the transporting direction; and driving means for driving said two tensioning means, said driving means including a drive shaft, driving motor means for rotating said drive shaft at a rotational speed and free wheel coupling means provided in each of said tensioning means for transferring a driving momentum only in said transport direction from said drive shaft to each said tensioning means and for allowing free rotational movement of each of said tensioning means at rotational speeds higher than said rotational speed of said drive shaft.

2. An apparatus according to claim 1, wherein each said tensioning means comprises a rigid drum coupled to said drive shaft via said free-wheel coupling means and hinge means for pivotally supporting said rigid drum with respect to an axis of rotation of said drive shaft.

3. An apparatus according to claim 1, wherein said hinge means is provided between said free-wheel coupling means and said drive shaft.

* * * * *